US006591463B2

(12) United States Patent
Wang

(10) Patent No.: US 6,591,463 B2
(45) Date of Patent: Jul. 15, 2003

(54) ZIPPER WITH MULTIPLE AND ALTERNATE COLORS

(76) Inventor: Wallace Wang, No. 273, San Chun St., Taipei (TW)

( * ) Notice: Subject to any disclaimer, the term of this patent is extended or adjusted under 35 U.S.C. 154(b) by 0 days.

(21) Appl. No.: 10/014,524

(22) Filed: Dec. 14, 2001

(65) Prior Publication Data

US 2003/0110599 A1 Jun. 19, 2003

(51) Int. Cl.[7] ..... A44B 19/14

(52) U.S. Cl. ..... 24/396; 24/394; 24/398; 24/405; 24/431

(58) Field of Search ..... 24/396, 394, 398, 24/405, 431, 432

(56) References Cited

U.S. PATENT DOCUMENTS 3,768,125 A * 10/1973 Frohlich ..... 24/396
5,035,029 A * 7/1991 Horita et al. ..... 24/394
5,042,117 A * 8/1991 Tsubata ..... 24/432
5,713,110 A * 2/1998 Covi et al. ..... 24/431
5,962,040 A * 10/1999 Dais et al. ..... 425/290
6,021,557 A * 2/2000 Dais et al. ..... 24/396
6,092,267 A * 7/2000 Covi et al. ..... 24/431
6,293,701 B1 * 9/2001 Tomic ..... 383/64
6,314,623 B1 * 11/2001 Wakai et al. ..... 24/398

FOREIGN PATENT DOCUMENTS

JP 11-320698 * 11/1999 ..... 24/396

* cited by examiner

*Primary Examiner*—Victor Sakran
(74) *Attorney, Agent, or Firm*—Rosenberg, Klein & Lee

(57) ABSTRACT

A zipper with multiple and alternate colors comprises a core and a plurality of zipper teeth. The core has multiple and alternate colors by printing, color transferring or color coverage. The pigmented core is subjected to a color fixing process. The core with multiple and alternate colors is embedded into the transparent zipper teeth

4 Claims, 5 Drawing Sheets

ZIPPER WITH MULTIPLE AND ALTERNATE COLORS

FIELD OF THE INVENTION

The present invention relates to a zipper with multiple and alternate colors, especially to a zipper with multiple and alternate colors to provide personal fashion and colorful effect to garments.

BACKGROUND OF THE INVENTION

The zippers are widely used for garments, handbag and other personal accessories and provide great convenience for people.

FIG. 1 shows a prior art zipper 10 comprising a core 11, a plurality of zipper teeth 12 and a plurality of sutures 13. The zipper teeth 12 are formed by injection molding from a forming machine (not shown) such that the core 11 is embedded into the zipper teeth 12. Afterward, a plurality of sutures 13 are used to secure the zipper teeth 12 to the core 11. The zipper 10 can be can be pulled by a slide (not shown) to lock or unlock the locking structures 14 formed on the zipper teeth 12. Therefore, the zipper is locked or unlocked.

However, the zipper 10 is generally of mono color and therefore not suitable for fancy garments.

Conventionally the zipper teeth 12 can be colored by printing or electroplating. However, the color of the zipper teeth 12 are liable to faded or flaked after repeated uses, for example, repeated zipping of the slide.

SUMMARY OF THE INVENTION

It is the object of the present invention to provide a zipper with multiple and alternate colors to provide personal fashion and colorful effect to garments.

To achieve above object, the present invention provides a zipper with multiple and alternate colors. The zipper comprises a core, a plurality of zipper teeth and a plurality of sutures. The core has multiple and alternate colors by printing, color transferring or color coverage. The pigmented core is subjected to a color fixing process. The zipper teeth are formed by injection molding from a forming machine such that the core is embedded into the zipper teeth. The sutures are used to secure the zipper teeth to the core.

The various objects and advantages of the present invention will be more readily understood from the following detailed description when read in conjunction with the appended drawing, in which:

DETAILED DESCRIPTION OF THE INVENTION

Figure 1:
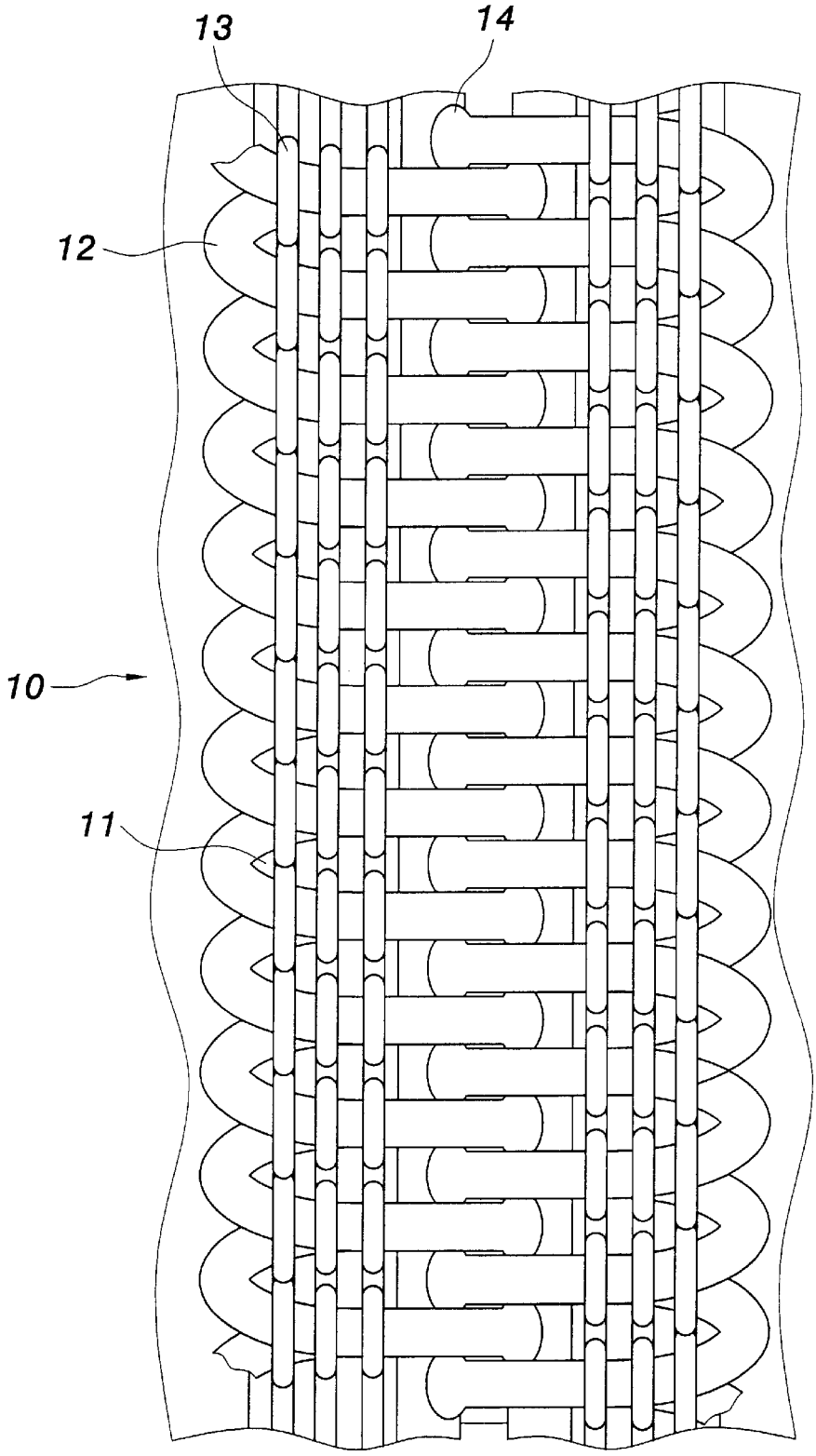
FIG. 1 PRIOR ART
FIG. 1 shows a top view of prior art zipper.
Figure 2:
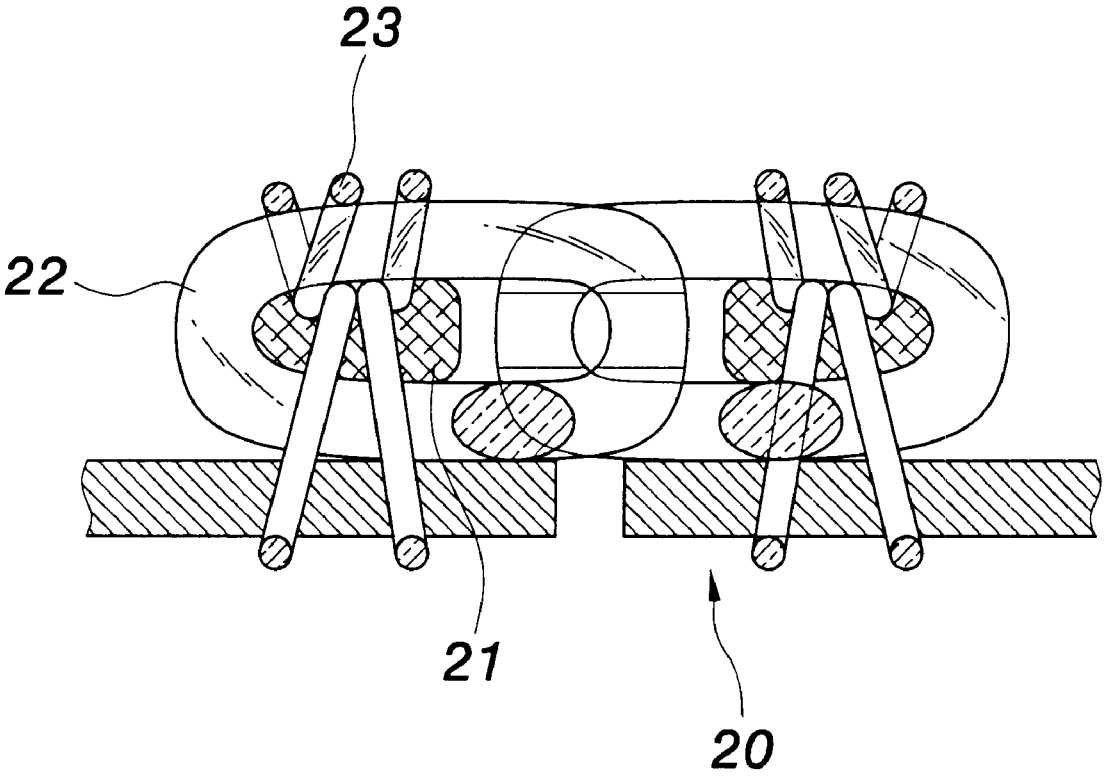
FIG. 2 shows a sectional view of the zipper of the present invention.
Figure 3:
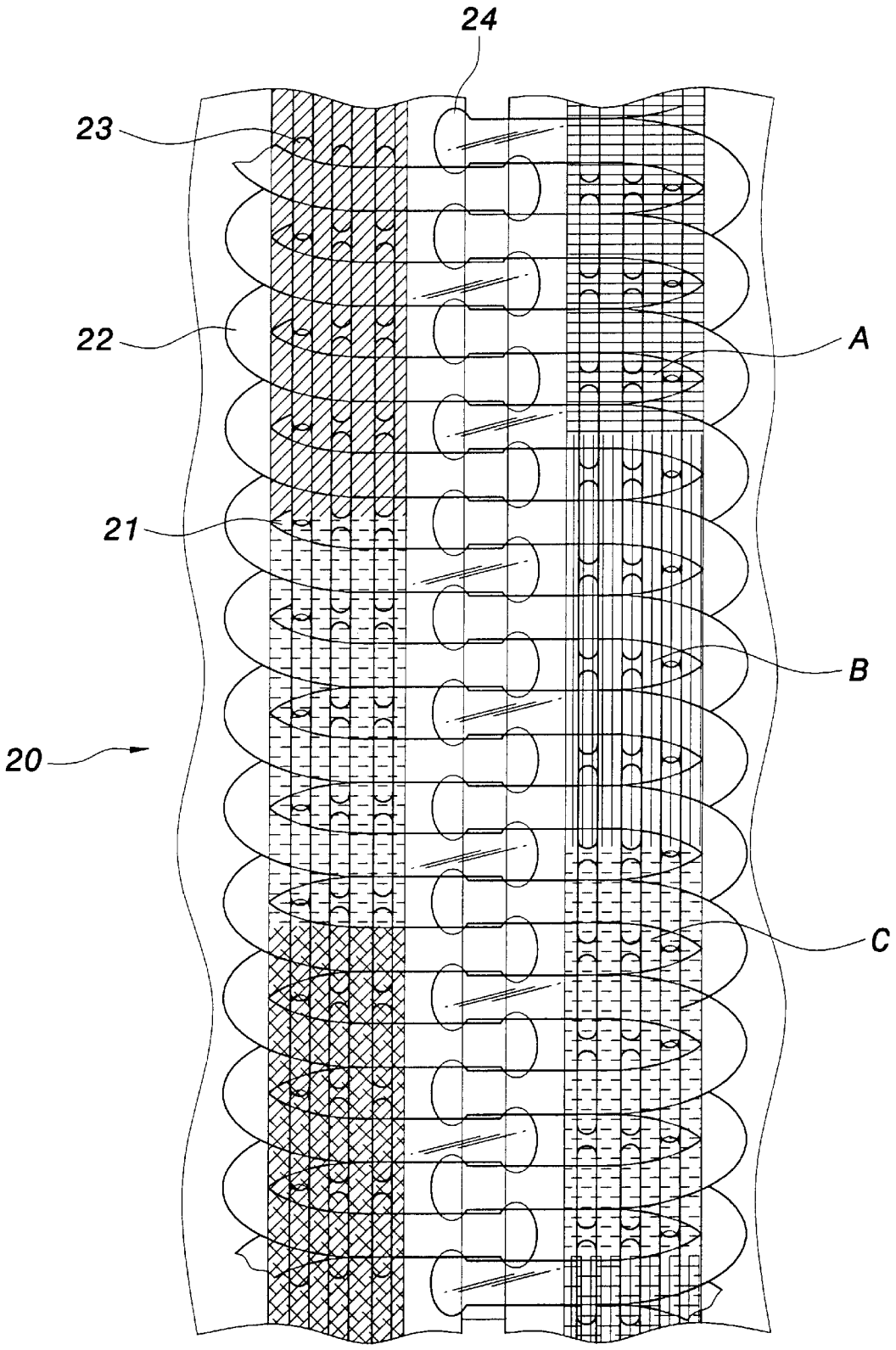
FIG. 3 shows a top view of the zipper of the present invention.
Figure 4:
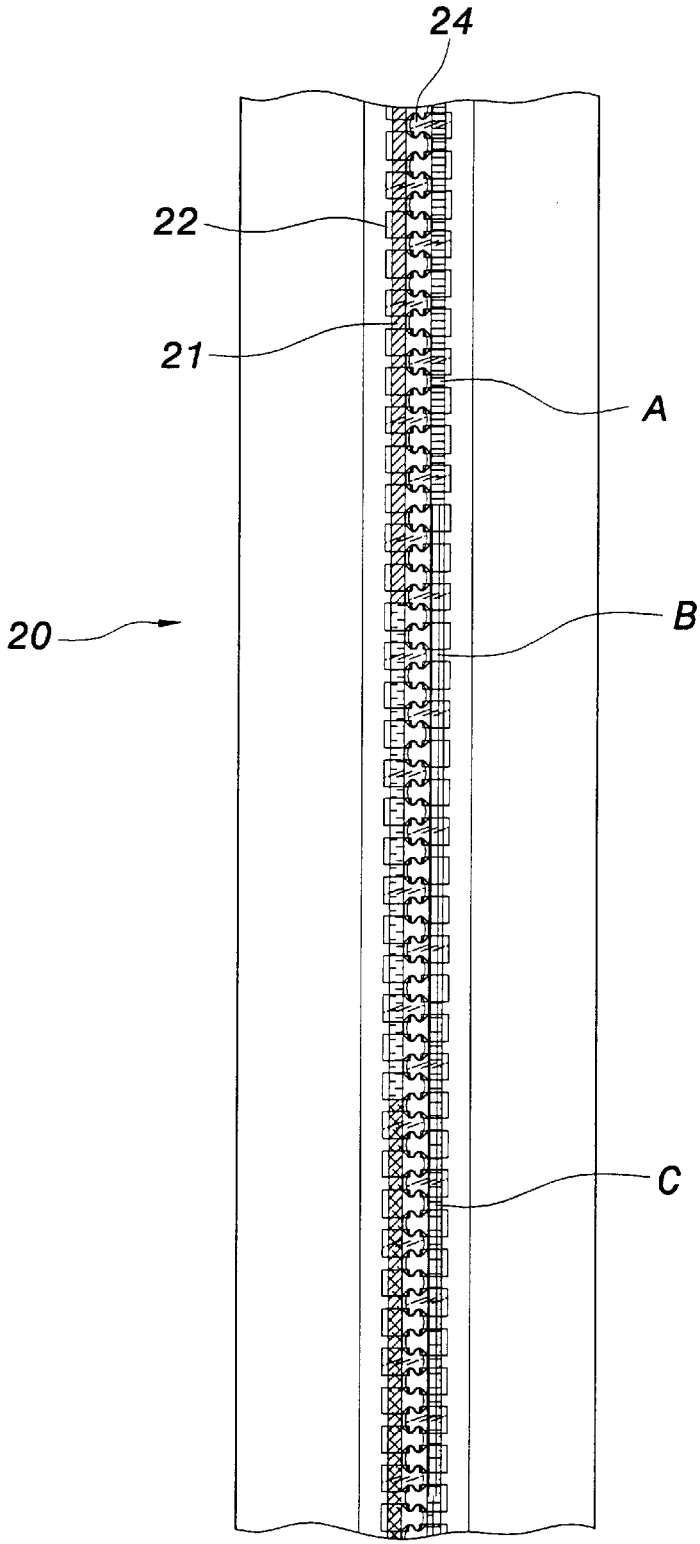
FIG. 4 shows a top view of the zipper of another preferred embodiment of the present invention.

With reference now to FIGS. 2 and 3, the present invention is intended to provide a zipper with multiple and alternate colors to provide personal fashion and colorful effect to garments. The zipper 20 according to the present invention comprises a core 21, a plurality of transparent zipper teeth 22 and a plurality of sutures 23. The zipper teeth 22 are formed by injection molding from a forming machine (not shown) as shown in FIG. 3 or by casting as shown in FIG. 4. Therefore the core 21 is embedded into the zipper teeth 22. Afterward, a plurality of sutures 23 are used to secure the zipper teeth 22 to the core 21. The zipper 20 can be can be pulled by a slide (not shown) to lock or unlock the locking structures 24 formed on the zipper teeth 12. Therefore, the zipper 20 is locked or unlocked. However, the operation of zipper is not important issue of the present invention and the detailed description thereof is omitted here.

Figure 5:
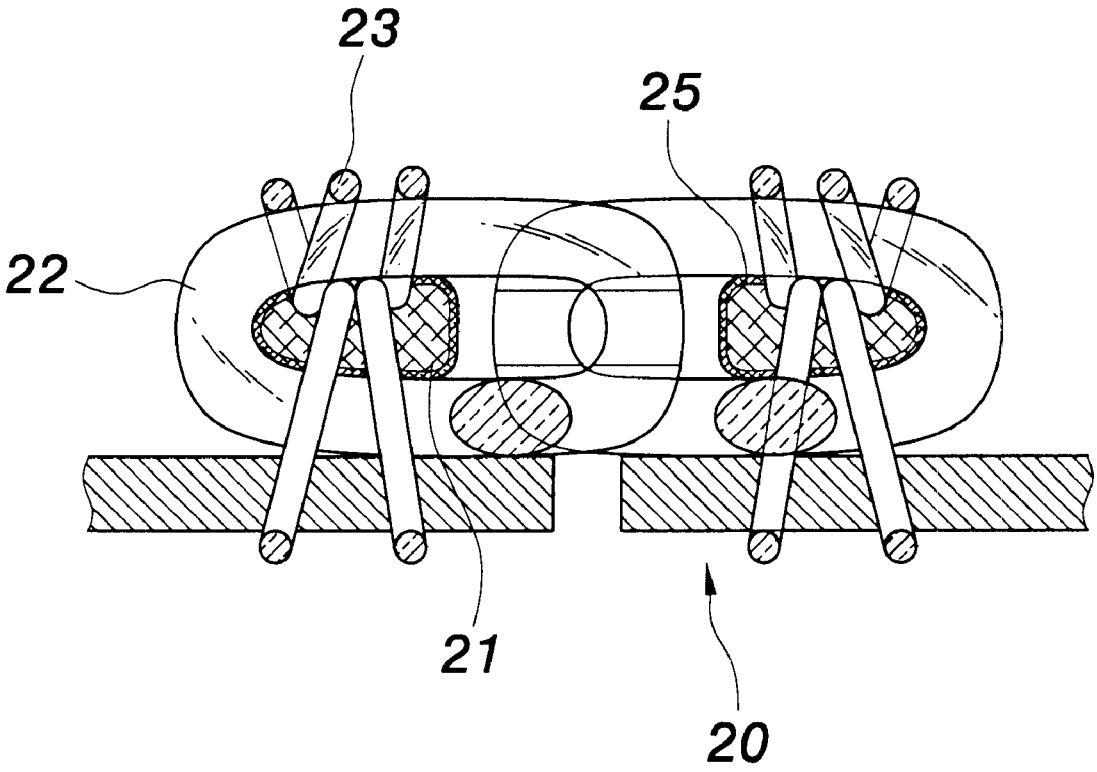
FIG. 5 shows a top view of the zipper of still another preferred embodiment of the present invention.

With reference now to FIGS. 2 to 5, the zipper teeth 22 of the present invention are transparent. Moreover, the core 21 has multiple and alternate colors by printing, color transferring or color coverage as shown in FIG. 5. The pigmented core 21 is then subjected to a color fixing process. Moreover, the core 21 with multiple and alternate colors is embedded into the transparent zipper teeth 22. Therefore, the color of the pigmented core 21 can be prevented from fading after repeated uses. More particularly, as shown in FIG. 3, the core 21 has symmetric or asymmetric color A, color B and color C in alternate pattern.

To sum up, the zipper with multiple and alternate colors according to the present invention has following advantages:

(1). The core 21 is subjected to a printing, color transferring or color coverage to have multiple and alternate colors in symmetric or asymmetric pattern. The transparency of the zipper teeth 22 facilitates the display of the colorful core.

(2). The colorful core 21 is advantageous for design and manifesting personal fashion.

(3). The core 21 with multiple colors is embedded into the transparent zipper teeth 22. Therefore, the color of the pigmented core 21 can be prevented from fading after repeated uses.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A zipper with multiple and alternate colors, comprising a core, a plurality of zipper teeth and a plurality of sutures;

the zipper teeth being formed by injection molding, the zipper teeth each having an upper portion extending transversely to define an inner space therebeneath, the core passing at least partially through the inner space of each of the zipper teeth, the sutures being used to secure the zipper teeth to the core;

wherein the zipper teeth are transparent and the core has multiple and alternate colors, the colors of the core being visible in substantially undistorted manner through the upper portions of the zipper teeth.

2. The zipper with multiple and alternate colors as in claim 1, wherein the core has the multiple and alternate colors printed thereon.

3. The zipper with multiple and alternate colors as in claim 1, wherein the core has the multiple and alternate colors formed thereon by color transferring.

4. The zipper with multiple and alternate colors as in claim 1, wherein the core has the multiple and alternate colors formed thereon by color coverage.

* * * * *